US007690963B2

(12) United States Patent
Whitehead

(10) Patent No.: US 7,690,963 B2
(45) Date of Patent: Apr. 6, 2010

(54) PLAY MAT

(75) Inventor: Brian Charles Whitehead, London (GB)

(73) Assignee: Origin Products Ltd., London (GB)

( * ) Notice: Subject to any disclaimer, the term of this patent is extended or adjusted under 35 U.S.C. 154(b) by 376 days.

(21) Appl. No.: 11/345,992

(22) Filed: Feb. 2, 2006

(65) Prior Publication Data

US 2006/0128259 A1 Jun. 15, 2006

Related U.S. Application Data

(63) Continuation of application No. 10/778,652, filed on Feb. 12, 2004, now abandoned.

(30) Foreign Application Priority Data

Feb. 14, 2003 (GB) ..... 0303346.1

(51) Int. Cl.
*A63H 33/26* (2006.01)
*A63H 33/04* (2006.01)

(52) U.S. Cl. ..... 446/129; 446/92

(58) Field of Classification Search ..... 446/129, 446/132, 137, 138, 139, 487, 92; 273/239, 273/443, 448, 456; 434/73, 168, 190
See application file for complete search history.

(56) References Cited

U.S. PATENT DOCUMENTS 3,034,140 A * 5/1962 Reynolds ..... 4/583
3,093,919 A 6/1963 Holtz
3,124,356 A 3/1964 Chordas
3,224,772 A 12/1965 Wells et al.
3,685,170 A 8/1972 Fairleigh
5,069,951 A * 12/1991 Egan ..... 428/172
5,102,129 A 4/1992 Roberts
5,332,215 A 7/1994 Gonzales
5,503,891 A 4/1996 Marshall et al.
5,524,317 A * 6/1996 Nagahama et al. ..... 15/217
5,662,326 A * 9/1997 Gebran ..... 273/239
5,820,383 A * 10/1998 Levins ..... 434/238
5,993,218 A * 11/1999 Kapell ..... 434/168
5,994,990 A * 11/1999 Ogikubo ..... 335/285
6,484,428 B1 * 11/2002 Greenwald et al. ..... 40/600
6,530,096 B1 3/2003 Mayhew et al.
7,078,085 B2 * 7/2006 Nykamp et al. ..... 428/99
2003/0138620 A1 * 7/2003 Fonseca ..... 428/317.1

FOREIGN PATENT DOCUMENTS

DE 100 34 280 A1 1/2002
GB 1 275 136 5/1972
GB 1 458 975 12/1976
GB 2090146 A 7/1982

* cited by examiner

*Primary Examiner*—John Ricci
(74) *Attorney, Agent, or Firm*—Woodard, Emhardt, Moriarty, McNett & Henry LLP

(57) ABSTRACT

The invention relates to the provision of a playmate and also a toy which includes a playmate and articles to be placed thereon in play. The playmat includes at least a portion, more typically a layer, of a magnetic or magnetically attractive material such as a metalised compound. The articles include magnetic or magnetically attractive material therein such that when the child brings the article into proximity with the playmate a magnetic field is created which acts to retain the article in position where placed by the child. The article is retained at that location until the child exerts a movement force on the article to overcome the magnetic force.

15 Claims, 2 Drawing Sheets

PLAY MAT

CROSS-REFERENCE TO RELATED APPLICATIONS

The present application is a continuation of U.S. patent application Ser. No. 10/778,652, filed Feb. 12, 2004, no abandoned and which claim priority to Great Britain Patent Application Number 0303346.1, filed Feb. 14, 2003, entitled PLAY MAT.

The invention to which this application relates is to a play mat for use by children, typically in conjunction with other articles provided to be placed thereon. Typically, but not exclusively, the articles to be placed thereon are linked to a scene or scenes depicted on the playmat to form, in conjunction, a toy or plaything in accordance with the invention.

The use of play mats for children to play on or adjacent to, is well known. Typically the play mats can be formed of plastic sheet material, felt or other cloth fabric. In whichever format, the play mat typically has a bottom surface which is provided to lie on the floor or ground and an upper surface on which the child plays. The upper surface can typically have a scene or scenes printed or applied thereto so as to add to the enjoyment which can be gained by the child from the play mat. The scene can, for example, be a series of roads, the rooms of a building or indeed can depict a game or games. In some scenarios of use of the play mat, other articles are provided to be used such as, for example, cars, figures of animals, humans, plants and inanimate objects.

Although the use of play mats is well known, the use of the same has been unchanged for many years and there are several known problems associated with such play mats. One such problem is that, when stored, the play mats are typically folded or rolled up and this means that when the same ate subsequently laid out for play, the same do not lie flat and this means that other articles are typically required to be placed on the play mat such as, for example, weights or the like at corners of the play mat to keep the same flat.

As a result of the lack of a flat upper surface, the articles which are placed on the play mat often are not easily maintained in a standing position due to unevenness in the surface of the play mat, typically due to the reasons given for the previous disadvantage, or that the underlying surface is uneven or on a slope, especially if the play mat is used outside, or that the article itself does not have a sufficiently large base so as to be stable in a standing position, or the same is easily knocked over by the child when the child is playing elsewhere on the play mat.

In addition to the inconvenience and disruption to the child's play caused by the articles falling over, there is also the possibility of the articles being broken as a result of them falling over and then possibly being stood on or leant on by the child.

Despite these well known disadvantages, no real attempt or solution has, to this date, been provided other than to provide a series of protrusions with which articles can engage via male and female location means. However this alters the surface area of the play mat and restricts the areas and available positions for location of the articles.

The aim of the present invention is to provide an improved play mat which can still be stored and used in a conventional manner but which overcomes the disadvantages illustrated above.

In a first aspect of the invention there is provided a play mat for the selective placement of at least one article on a surface thereof in play, said play mat having a surface for contact with a support surface and an upper surface, said upper surface provided for the location of the at least one article thereon and characterised in that the play mat includes a portion formed of magnetic or magnetically attractive material.

In one embodiment, the layer of metalised material is in the form of a metalised compound which includes metal embedded therein and scattered throughout the compound so as to give the metalised effect.

In one embodiment the upper surface of the play mat has a scene depicted thereon. Typically this scene is printed on a layer laminated to the metalised compound layer and depicts any scene as required. In one embodiment, the play mat comprises a first layer at or adjacent the bottom surface which comprises the metalised compound and at or adjacent the upper surface, a layer of fabric or plastics material which carries the printed scene which is located to form the upper surface of the play mat. Typically the plastics or fabric layer is laminated or otherwise bonded to the metalised rubber or plastic compound layer.

Although described above with an additional layer carrying the printed scene, it is possible and indeed preferred that the scene depicted is applied directly to the metalised layer thereby offering reduction in cost while ensuring that the scene depicted is attractive and clearly defined to the child.

The play mat, in accordance with the invention is typically flexible, can be reduced in size by folding, rolling or the like to a storage condition and then, when required for use, is unfolded or unrolled and laid flat on the support surface such as a floor or lawn. Due to the weight of the metalised rubber compound layer and a natural resilience of the play mat which is achieved through use of the metalised rubber compound, the play mat lies substantially flat on the support surface and therefore presents a flat stable surface for use by a child and on which the child can place articles as required.

In a further aspect of the invention there is provided a toy, said toy comprising a play mat and at least one article to be selectively placed on said play mat in play, said play mat having an upper surface on which the said at least one article can be placed and a lower surface for placement on a support surface, characterised in that the play mat is formed with at least a layer of magnetic or magnetically attractive material and the said article includes a magnet or magnetically attractive material therein such that when the article is brought into proximity with the upper surface of the play mat, magnetic attraction between the article and the play mat acts to retain the article in the placed position on the play mat.

Although it is preferred that the magnetic material is provided in the article and magnetically attractive material in the form of the metalised compound is provided in the play mat, it is possible and within the scope of the invention that the metalised material in the play mat is magnetised and the article can, but need not, include magnetic material but rather can include a metal therein to allow the magnetic field to be created.

Typically the play mat incorporates a play scene on the upper surface of the same and, in one embodiment, instead of the metalised layer being provided across the entire play mat area, which is one embodiment, the magnetically attractive material of the play mat is provided at selected locations which match with particular portions of the displayed scene such that the article can be retained by the magnetic force in those particular areas. However, most typically, the metalised material layer will extend across the play mat area.

Typically, a plurality of articles are provided to be used in conjunction with the play mat. Preferably, but not necessarily, each article is selectively locatable on the play mat and retained in position by the magnetic attraction between the magnetic or magnetically attractive material in the articles and the magnetic or magnetically attractive material of the play mat.

In one embodiment, the strength of magnetic attraction between the articles and the play mat can be selected on an article by article basis such that certain articles within the plurality of articles can have material with different magnetic strengths. For example, if some of the articles comprise model houses which, in play would be envisaged as being permanently placed in position, these articles can be provided with magnetic material of a strength greater than, for example, articles depicting a human or animal which would be expected to be played with by a child and moved around the play mat more often. Thus, the greater magnetic attraction allows a greater degree of permanency of location of certain articles than others as required. In a further embodiment not all of the articles are provided with magnetic material. In certain instances this can be simply a matter of choice for the particular articles. If, for example, certain of the articles are relatively heavy, the weight of the same may be sufficient to keep the same in position and therefore the magnetic material is not required.

Specific embodiments of the invention ate now described with reference to the accompanying drawings wherein.

Figure 1:
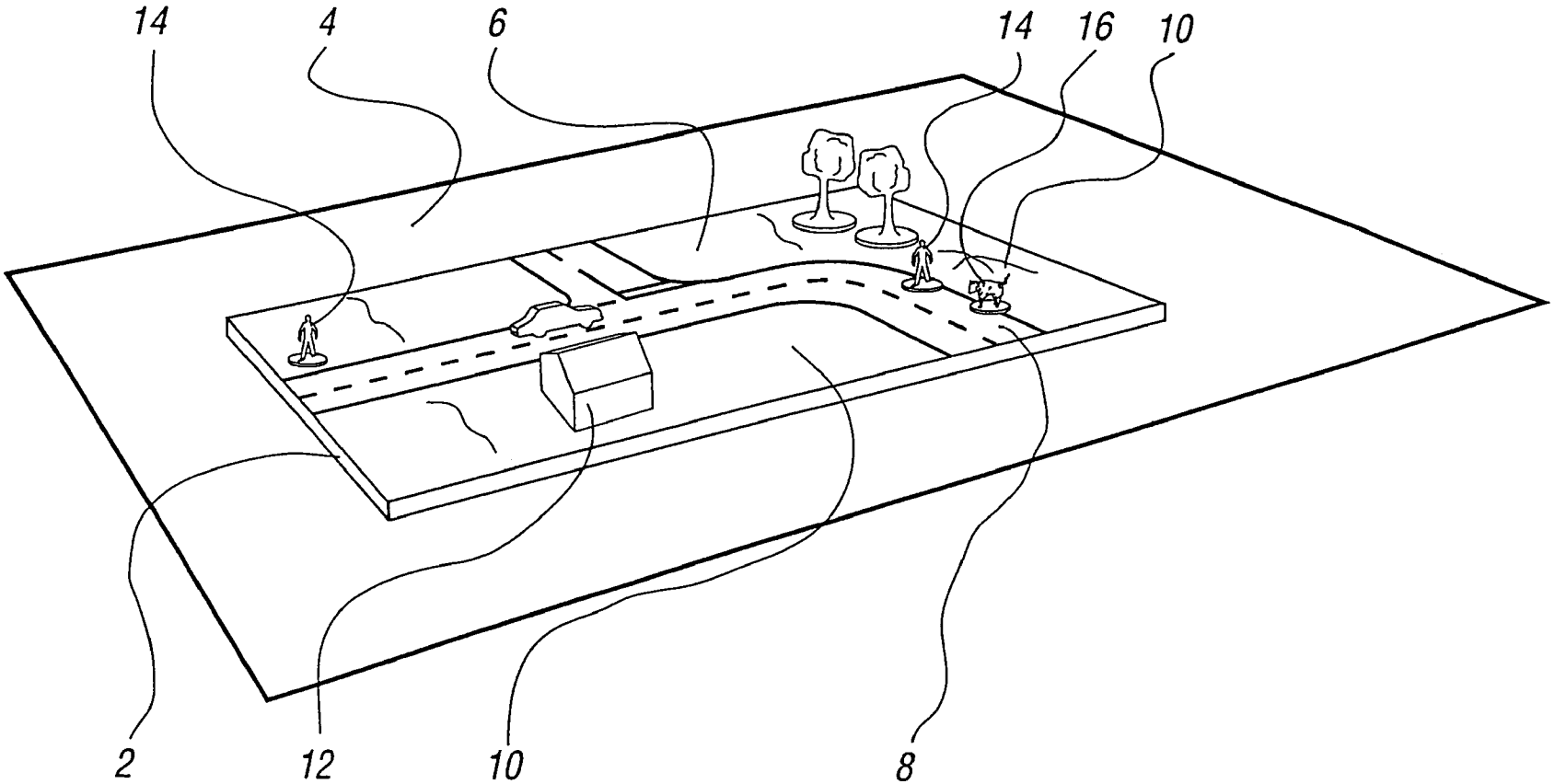
FIG. 1 illustrates a play mat and articles in use in accordance with one embodiment of the invention.

Referring firstly to FIG. 1, there is illustrated a play mat and articles in accordance with the invention in one embodiment in use. The play mat 2 is shown in an in-use position laid flat on a support surface 4. The upper surface 6 of the play mat is shown and in this case, depicts a plan view of roads 8 and gardens 10. In this embodiment, a series of articles are provided in the form of model houses 12, human characters 14 and animal characters 16. The articles can be placed as desired by the child on the surface 6. For example, the model houses 12 are provided to be placed, as indeed is shown, in location in a garden on the scene depicted on the surface 6. The human and animal characters 14, 16 are typically moved around the play mat by the child to various locations as shown in FIG. 1.

In each case, the articles include a magnetic material or magnetically attractive material placed therein, typically at or adjacent the base of same.

Figure 2:
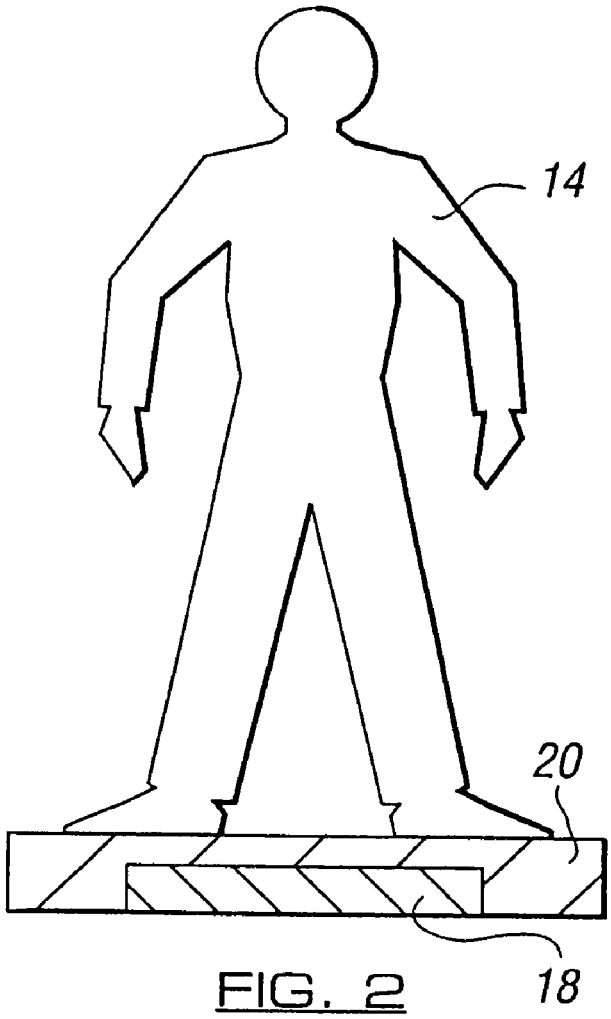
FIG. 2 illustrates a cross section through one of the articles.

FIG. 2 illustrates a cross section through one example of an article in accordance with the invention in the form of a model person 14. This view clearly shows the provision of magnetic material or magnetically attractive material 18 in the base 20 of the article. Although illustrated with a base in which the magnetic material is provided it is possible that many alternative article forms can be used. Indeed in the applicant's co-pending applications GB0213339.5 and GB0219453.8 there is described an article made from a flexible material and provided with feet portions which directly contact the surface with magnetic material provided in each foot portion and which would be suitable for use with this invention. The magnetic material or magnetically attractive material can therefore be provided in selected portions of the article to allow the article to be positioned on the play mat with the magnetic or magnetically attractive material positioned at or adjacent to the play surface and acting to retain the article in position.

Figure 3:
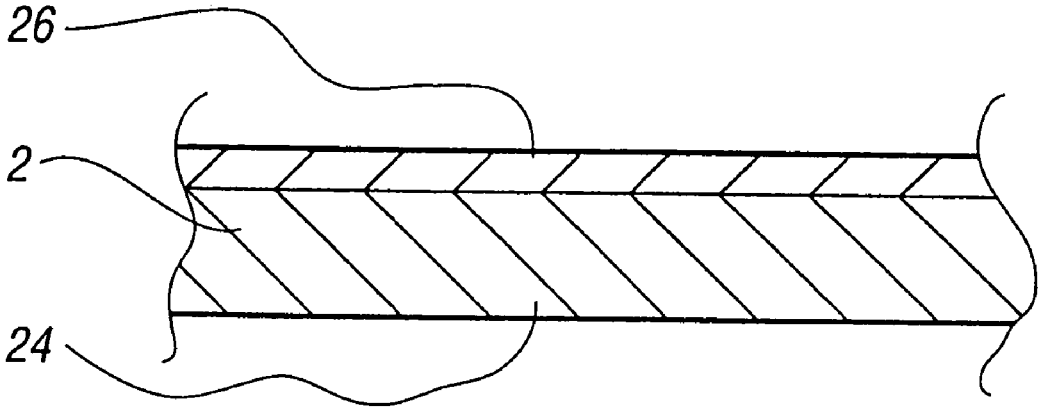
FIG. 3 illustrates a cross section through the play mat in one embodiment.

FIG. 3 illustrates a cross section through the play mat 2 of FIG. 1 and shows how, in the embodiment shown, the playmat is formed of a first layer 24 of a compound material such as rubber or plastics material which includes metal particles therein and which can be referred to as being "metallised". One known compound of this form is sold under the trade mark FLEXMET but there are other similar compounds available. The compound includes pieces of metal located therein so as to provide a metalised effect and in this arrangement the article is provided with a magnetic material so as to form a magnetic field between the article and the playmat layer 24 and so attract the article into location and thereafter provide a retaining force on the article to stay in that position on the playmat until the child exerts a removal force on the article.

The playmat also includes a second layer 26 which forms the upper surface of the play mat and can be formed of fabric, plastics or any suitable sheet material. This layer 26 in this embodiment carries printed material thereon which allows the depiction of the scene on the upper or play surface to the child and with which the child interacts. In an alternative, and in certain cases, preferred embodiment the layer 26 is not provided and instead the printed scene is applied directly to the layer 24 with the playmat formed only of the metalised material layer which can reduce the cost of the same.

In use, when the child wishes to play with the toy with the components of the play mat and articles, the play mat can be moved to a flat condition. By using the metalised material as herein described the playmat has sufficient weight to lie automatically in a substantially flat condition. When laid flat, the child can place articles onto the upper surface and move the articles around the upper surface as they require with the magnetic attraction between the article and playmat allowing retention of the article in selected locations.

The location and/or strength of the magnetic material in the articles can be selected to control the level of the magnetic field created between the article and the playmat and hence the retention force between the article and the playmat. In one example, the retention forces can be varied between different articles or article types thereby allowing certain articles to be more permanently located in position on the play mat than other articles which may, for example, be expected to be moved around more often by the child during play.

Although described with regard to a magnetic material being provided in the articles and the metalised layer provided in the play mat, it should be appreciated that the invention will work in the same manner, with the same advantageous effect and is therefore within the scope of this patent application if the metalised layer in the play mat is also magnetised and the article is provided with either magnetic material or a magnetically attractive material to achieve the magnetic attraction.

The invention in accordance with this application therefore provides a playmat and toy which allows the provision of a flat play surface for a child and also the ability for a child to move articles with respect to the playmat and have the articles retained in positions selected by the child on the playmat by the magnetic attraction between the playmat and the article.

The invention claimed is:

1. A toy for positioning on a support surface, said toy comprising:

a play mat and articles, said play mat having a surface for contact with a support surface, and an upper surface provided for the placement of said articles thereon, said play mat including a play mat portion formed of magnetically attractive material in the form of a metalised compound, said metalised compound including portions of metal embedded therein and interspersed throughout said metalised compound and said play mat portion so as to provide a magnetically attractive layer of said play mat portion, wherein said play mat is flexible to allow the play mat to be rolled up into a storage configuration and has sufficient weight to lie in a substantially flat condition when in use, the articles including magnetically attractive material therein, such that when brought into proximity with the upper surface of said play mat, magnetic attraction between the articles and said play mat acts to retain the articles in placed positions on said play mat, wherein strength of the magnetically attractive material in the articles varies between the articles to allow variation in a retaining force applied to the articles relative to said play mat.

2. A toy according to claim 1, wherein the portion formed of magnetically attractive material is provided as a layer of said play mat.

3. A toy according to claim 1, wherein said upper surface includes a play scene depicted thereon.

4. A toy according to claim 1, wherein said magnetically attractive layer of said play mat is laminated to a layer provided with a play scene printed thereon.

5. A toy according to claim 1, wherein said play mat comprises a first layer formed of a material selected from the group consisting of metalised rubber and plastics compound, said play mat further comprising a second layer above said first layer and forming said upper surface of said play mat, said second layer carrying a printed play scene.

6. A toy according to claim 5, wherein said second layer is connected to said first layer by a method selected from the group consisting of bonding and laminating.

7. A toy according to claim 5, wherein said play mat further comprises a third layer which carries a printed scene.

8. A toy according to claim 1, wherein said upper surface of said play mat depicts a play scene printed directly onto the portion formed of magnetically attractive material.

9. A toy according to claim 1, wherein said play mat is movable between an in-use condition and a storage condition.

10. A toy according to claim 1, wherein the portion formed of magnetically attractive material extends throughout an entire area of said play mat.

11. A toy according to claim 1, wherein said metalised compound in said play mat is magnetised.

12. A toy according to claim 1, wherein the portion formed of magnetically attractive material in said play mat is provided at one or more selected locations in said play mat.

13. A toy according to claim 12, wherein a location of the portion formed of magnetically attractive material in said play mat matches with identifiable portions depicted on a play scene located on said upper surface of said play mat.

14. A toy for positioning on a support surface, said toy comprising a play mat and articles to be selectively placed on said play mat, said play mat having an upper surface on which the articles can be placed and a lower surface for placement of said play mat on the support surface, said play mat being formed with at least one layer of magnetically attractive material and the articles including magnetically attractive material therein, such that when the articles are brought into proximity with the upper surface of said play mat, magnetic attraction between the articles and said play mat acts to retain the articles in placed positions on said play mat, wherein strength of the magnetically attractive material in the articles varies between the articles to allow variation in a retaining force applied to the articles relative to said play mat; and wherein said play mat is flexible, said at least one layer of magnetically attractive material and the articles providing said play mat with sufficient weight to cause said play mat to lie in a substantially flat condition, said play includes metallic material interspersed throughout said play mat and extending substantially throughout an area of said play mat.

15. A toy according to claim 14, wherein the articles are provided to be used in conjunction with said play mat for selective location thereon and retained in position by magnetic attraction between the magnetically attractive material in the articles and said at least one layer of magnetically attractive material in said play mat.

* * * * *